US009428289B2

(12) United States Patent
Pape

(10) Patent No.: US 9,428,289 B2
(45) Date of Patent: Aug. 30, 2016

(54) METHOD AND APPARATUS FOR MAKING MEDIUM-FILLED PACKAGES

(75) Inventor: Henrik Pape, Horsens (DK)

(73) Assignee: REDDY ICE TECHNOLOGY LLC, Dallas, TX (US)

( * ) Notice: Subject to any disclaimer, the term of this patent is extended or adjusted under 35 U.S.C. 154(b) by 22 days.

(21) Appl. No.: 12/449,132

(22) PCT Filed: Jan. 24, 2008

(86) PCT No.: PCT/DK2008/000027

§ 371 (c)(1),
(2), (4) Date: Aug. 28, 2009

(87) PCT Pub. No.: WO2008/089762

PCT Pub. Date: Jul. 31, 2008

(65) Prior Publication Data

US 2010/0011710 A1 Jan. 21, 2010

(30) Foreign Application Priority Data

Jan. 24, 2007 (DK) ..... 2007 00109

(51) Int. Cl.
*B65B 9/02* (2006.01)

(52) U.S. Cl.
CPC ..... *B65B 9/023* (2013.01); *B65B 9/02* (2013.01); *B65B 2220/22* (2013.01)

(58) Field of Classification Search
CPC ..... B65B 9/20; B65B 9/02; B65B 9/093; B65B 9/2021; B65B 9/023; B65B 2220/22
USPC ..... 53/553–555, 451, 127, 202, 546, 459, 53/450
See application file for complete search history.

(56) References Cited

U.S. PATENT DOCUMENTS 2,334,256 A * 11/1943 Eaton ..... B65B 29/04 426/83
2,616,232 A * 11/1952 Meyer ..... 53/450
2,673,430 A * 3/1954 Fleischer et al. ..... 53/546
3,210,908 A * 10/1965 Samberg ..... 53/546
3,339,337 A * 9/1967 Rapp ..... B65B 9/06 53/550
3,383,269 A * 5/1968 Kopp ..... 156/553
3,597,894 A * 8/1971 Harrison ..... 53/451
3,817,803 A * 6/1974 Horsky ..... 156/85
3,868,285 A * 2/1975 Troy ..... 156/147

(Continued)

FOREIGN PATENT DOCUMENTS

EP 0999131 A1 5/2000
EP 1696192 A1 * 8/2006

(Continued)

*Primary Examiner* — Andrew M Tecco
(74) *Attorney, Agent, or Firm* — Haynes and Boone, LLP

(57) ABSTRACT

There is disclosed a method and an apparatus for making a medium-filled packing of two superposed heat-sealable elongated webs of plastic film (3) which are thermally sealed in longitudinal and transverse directions of the film webs for forming packings (11), and where the formed packings are filled by medium and closed. The film webs (3) are passed between a pair of rollers (6) which are pressed against each other, retaining the film webs therebetween. Thermal sealing across part of the width of the film webs is performed so that unbroken longitudinal areas (9) without any thermal sealing appear in the longitudinal direction of the film webs (3). The medium is filled into the packing before closing it for the formation of the medium-filled packing.

10 Claims, 8 Drawing Sheets

(56) References Cited

U.S. PATENT DOCUMENTS

| | | | | | |
|---|---|---|---|---|---|
| 3,881,296 | A * | 5/1975 | Bate | B65B 9/02 | 53/252 |
| 3,938,298 | A * | 2/1976 | Luhman et al. | | 53/403 |
| 4,107,900 | A * | 8/1978 | Izumi | | 53/555 |
| 4,169,344 | A * | 10/1979 | Ganz et al. | | 53/546 |
| 4,478,386 | A * | 10/1984 | Mikkelsen | | 249/83 |
| 4,587,810 | A | 5/1986 | Fletcher | | |
| 4,598,529 | A * | 7/1986 | Pongrass et al. | | 53/452 |
| 4,631,905 | A * | 12/1986 | Maloney | | 53/554 |
| 5,265,401 | A * | 11/1993 | Gujer et al. | | 53/546 |
| 5,335,486 | A * | 8/1994 | Davis | | 53/452 |
| 5,460,844 | A * | 10/1995 | Gaylor | | 426/394 |
| 5,516,386 | A * | 5/1996 | Savarese | | 156/210 |
| 5,981,028 | A * | 11/1999 | Sugawa | B29C 65/7437 | 222/105 |
| 6,112,539 | A * | 9/2000 | Colberg | | 62/331 |
| 6,237,308 | B1 | 5/2001 | Quintin et al. | | |
| 6,282,869 | B1 * | 9/2001 | Bullock et al. | | 53/434 |
| 6,579,584 | B1 * | 6/2003 | Compton | B65B 55/28 | 428/34.6 |
| 6,598,377 | B2 * | 7/2003 | Takahashi | | 53/550 |
| 6,725,625 | B1 | 4/2004 | Honma et al. | | |
| 6,811,527 | B2 * | 11/2004 | Andersson et al. | | 493/187 |
| 6,904,946 | B2 * | 6/2005 | James | B65B 43/123 | 141/114 |
| 6,971,221 | B2 * | 12/2005 | Sperry et al. | | 53/450 |
| 7,013,615 | B2 * | 3/2006 | Piucci, Jr. | B05B 7/0408 | 53/167 |
| 7,114,307 | B2 * | 10/2006 | Tada et al. | | 53/141 |
| 7,600,360 | B2 * | 10/2009 | Schroeder et al. | | 53/452 |
| 2006/0005564 | A1 * | 1/2006 | Metzger | | 62/344 |
| 2006/0021300 | A1 | 2/2006 | Tada et al. | | |

FOREIGN PATENT DOCUMENTS

| | | | |
|---|---|---|---|
| GB | 712485 | A | 7/1954 |
| JP | 03-002302 | A | 1/1991 |
| JP | 04-307005 | A | 10/1992 |
| JP | 5-132008 | | 5/1993 |
| WO | WO8204237 | A1 | 12/1982 |
| WO | 9935051 | A1 | 7/1999 |
| WO | WO 00/01582 | A1 | 1/2000 |
| WO | 2005016759 | A1 | 2/2005 |

* cited by examiner

METHOD AND APPARATUS FOR MAKING MEDIUM-FILLED PACKAGES

This application claims the benefit of Danish Application No. PA 2007 00109 filed Jan. 24, 2007 and PCT/DK2008/000027 filed Jan. 24, 2008, which are hereby incorporated by reference in their entirety.

FIELD OF THE INVENTION

The present invention concerns a method for making a medium-filled packing of two superposed heat-sealable elongated webs of plastic film which are thermally sealed in longitudinal and transverse directions of the film webs for forming packings, and where the formed packings are filled by medium and closed. The invention furthermore concerns an apparatus for use in making a medium-filled packing of two superposed heat-sealable elongated webs of plastic film which are thermally sealed in longitudinal and transverse directions of the film webs for forming packings, and where the formed packings are filled by medium and closed.

BACKGROUND OF THE INVENTION

It is prior art to make bags into which medium is filled afterwards. For example, this is known by making ice cube bags where medium in the form of water is filled into bags.

Furthermore, apparatuses by which packings that may be filled with medium in the shape of liquid are formed from two plastic film webs, which are either formed by a folded/U-shaped film or by using two superposed separate films, are known. In these designs, a packing is formed at first, which is subsequently filled with the liquid via a filling opening. Then the filling opening is closed, and the liquid-filled packing is ready for further handling.

Furthermore, there is also so-called form-fill-and-seal machines where a film is drawn over a shaping tube, whereby the film is folded for the formation of a packing tube. This packing tube is closed by a welding, and filling of the packing tube is effected through the shaping tube around which the film is folded. Common to the prior art machines is the application of strong and thick films for providing a sufficiently strong packing.

It is thus commonly known that bags are filled with medium in the form of liquid, while they are on a supporting surface, as the film is inadequate for carrying the weight of the bags.

Particularly in connection with bags that are thermally sealed or welded, a softening and weakening of the material occurs, so that there is less load-bearing ability in the heated and softened material. This puts greater demands on the support of the packing during and after the filling of medium.

Examples of prior art methods are known from e.g. U.S. Pat. No. 4,598,529, U.S. Pat. No. 4,587,810, WO 82/04237 and EP 0 999 131.

Common to the techniques described in these publications is the use of thick plastic films and/or use of complicated equipment for application in the making of medium-filled packings.

From U.S. Pat. No. 4,598,529 is also known a method and an apparatus for forming flexible plastic bags with two sides which are formed by superposed plastic webs and for filling the bag with liquid. The system described includes, however, the formation of a bag. This bag is subsequently provided with a slit at one side for filling liquid by means of a filling nozzle. The slit is subsequently closed by thermal sealing means that welds the to sides together. According to this technique, the packing is thus not formed successively while simultaneously being filled. Moreover, according to this art thermal sealing occurs across the entire width of the plastic webs so that a weakening of the material appears such that the web cannot carry a filled packing. There is no indication of the possibility of placing a liquid-filled packing directly in a sales unit and/or distribution unit.

For many years there has been a wish of providing packings filled by medium, preferably a liquid in the shape of water. Also, is has been desired to be able to make such medium-filled packings in the form of ice cube bags, where ice cubes are formed after freezing.

Furthermore, for many years it has been a wish to be able making ice cubes where the risk of bacterial growth is avoided, as known from traditional ice cube machines where the ice cubes are formed in a freezing compartment.

Moreover, there has also existed a wish for making water containers where the risk of bacterial growth is avoided by distributing water directly from a flexible liquid container. In the prior art containers, air penetrating into the container will cause the introduction of oxygen. Thereby a risk of bacterial growth is present.

OBJECT OF THE INVENTION

It is the object of the present invention to indicate a method and an apparatus which is technically simple and which enables the making of medium-filled packings by using thin films. It is thus an object that the method and the apparatus can be used for making medium-filled packings which during the making of the packing can be filled with the medium irrespectively whether it is a solid medium or a liquid medium, and irrespectively whether the medium after filling into the packing is to be treated or is ready for distribution and/or use, so that it is possible to avoid using ready-made packings/bags and thereby to use cheaper packings/bags and to avoid changing magazine with the finished packings/bags.

It is furthermore a particular object to indicate a method and an apparatus where such medium-filled packings can be used for making ice cubes, for making liquid-filled packings/containers for water machines and for use in filling ice cubes directly into a packing during the formation of such a packing, as the risk of bacterial growth is avoided hereby.

DESCRIPTION OF THE INVENTION

According to the present invention, this is achieved by a method of the kind mentioned in the introduction, which is peculiar in that the film webs are passed between a pair of rollers, that they are pressed against each other, retaining the film webs therebetween, that thermal sealing is performed at a position downstream of the rollers, that the thermal sealing is performed across part of the width of the film webs so that at least one and preferably two or more unbroken longitudinal areas, where no thermal sealing occurs, appear in longitudinal direction of the film webs, that the medium is filled into the packing before it is closed for forming the medium-filled packing, and that the medium-filled packing is subsequently separated from the film webs.

The apparatus according to the invention is peculiar in that it includes

- a pair of rollers between which the film webs are passed;
- means for pressing the rollers against each other for retaining the film webs therebetween;
- means for performing thermal sealing, the means being disposed at a position after the rollers as seen in the conveying direction of the film webs;

means for filling medium into the packing before the packing is closed for formation of the medium-filled packing; and means for separating the medium-filled package from the film webs;

that the width of the thermal sealing means is adapted for performing a thermal sealing extending across a part of the width of the film webs, so that at least one and preferably two or more unbroken longitudinal areas where no thermal sealing occurs appear in the longitudinal direction of the film webs.

By a system according to the present invention it is possible to have a film storage, either in the form of film which is folded into U-shape for forming two superposed packing webs, or alternatively a storage of two separate films that are joined for forming the superposed elongated webs. Alternatively, the film may be provided as a tube which is pressed together, forming two superposed film layers. The two superposed heat-sealable elongated webs of plastic film are thus formed either by folding a film or by superposing two films.

By the system according to the invention it thus becomes possible to avoid using readymade packings/bags. This will enable making the packing/bag directly in or in direct connection with a distribution unit/sales unit while simultaneously filling it with the medium. Hereby, cheaper packings/bags can be used, and the user may avoid changing magazine with the finished packings/bags.

From the film storage, the film webs are passed between one or more pairs of rollers for controlling and unwinding the film in the ordinary way. However, only one pair of rollers is needed where the film webs are passed through, as the roller pair exert a squeezing force around the film web. The squeezing force exerted against the film is to be adapted so that the film web does not slide between the rollers when the packing to be formed is filled with medium.

Means for medium filling and thermal sealing can be provided immediately after the rollers.

The medium filling means may be of any type for filling liquids or solids and wherein there are blocking means for controlling the medium filling action.

The medium filling means may e.g. be a liquid supply pipe with shut-off valves for controlling the filling.

The medium filling means may e.g. be a water supply pipe with shut-off valves for controlling the filling.

The medium filling means may be a funnel or a screw conveyor, the outlet of which being provided with shut-off means for controlling the filling.

The medium filling means may be an ice cube machine, the outlet of which being provided with shut-off means for controlling the filling.

The thermal sealing means may e.g. be welding jaws that are reciprocatingly moved into and out of contact with the film webs.

Alternatively, heated rollers may be used which perform a longitudinal heating/thermal sealing of the two webs to each other. The film web is advanced by the rotation of the rollers which operate continuously or stepwise.

If the method is used for the formation of packings containing a compartmentation, as e.g. in ice cube bags, welding jaws for the formation of the compartmentation are actuated alternating with liquid filling, so that compartments are formed continuously which are filled with liquid before closing the packing for the formation of the liquid-filled packing.

The method may also be used with actuating welding jaws for the formation of one compartment, the volume of which being enlarged by actuation alternating with medium filling, so that continuously there is formed a larger compartment which is filled by medium before the closing of the packing for forming the liquid-filled packing.

Irrespectively whether the method is applied for the formation of a compartmentalised packing or a packing with one compartment, the volume of which being enlarged by actuation alternating with medium filling, e.g. an ice cube bag, the weight of the medium filled into the partly formed packing at first will contribute to pulling the packing and ensuring its movement during the filling before closing the packing for the formation of the medium-filled packing.

Alternatively, a packing may be filled with liquid, and then a compartmentation can be performed in that the film webs are pressed together and welded through the liquid.

By using the method, the forming of packings containing one large compartment, firstly a transverse thermal sealing is performed and subsequently a longitudinal thermal sealing is performed simultaneously with the medium filling before closing the packing for forming the medium-filled packing. The longitudinal sealing may be performed in one or more steps. Closing of the packing will usually be effected by a further transverse thermal sealings running between the longitudinal thermal sealing so that one or more closed compartments are formed between the longitudinal and transverse thermal sealings.

The transverse thermal sealings will always have a length adapted for a thermal sealing extending across a part of the width of the film webs, so that the above mentioned unbroken longitudinally extending areas where no thermal sealing occurs appear in the longitudinal direction of the film webs are established.

The thermal sealing means and the medium filling means are actuated synchronised with the rollers and thereby the movement of the film web. The packing thus formed will therefore be suspended in the film web extending between the two rollers. As the thermal sealing of the film web does not extend across the entire width of the film web, longitudinal areas will appear in longitudinal direction of the film webs in which no weakening occurs due to thermal sealing/heating. It is thus possible to use film where the widths of these longitudinal areas are dimensioned with such thickness of film and width of the areas in order to carry the weight of the packing when it is filled with the medium in the position where it is suspended by the rollers. After the medium has been filled into the packing, a closing will be performed for forming of the medium-filled packing. Then the medium-filled packing is separated from the film webs.

The unbroken longitudinally extending areas in which no thermal sealing is performed may be provided at any area across the width of the film webs. However, in a particularly simple embodiment it is preferred that these longitudinal areas is an edge area adjoining each longitudinal edge of the film webs. A welding formed in the longitudinal direction of the film webs in order to form sides in the formed packing may thus be made at a distance from the width of the film webs in the case of two superposed webs. At both side edges there will hereby be an area where no welds appear. Between the two longitudinal weldings forming side edges in the packing, transverse weldings are formed which form bottom and top in the packing.

Alternatively, between bottom and top there may be performed a transverse thermal sealing extending across the width of the film between the two longitudinal weldings. Hereby may be provided a division into compartments or sections of the formed packing which thus would be suited for use in making ice cubes, but which also may have individual chambers containing another medium. In such a situation it is preferred that thermal sealing of the film webs and medium filling are performed alternatingly, as the medium is successively filled into the packing during the formation of the packing for forming medium-filled compartments or sections in the packing before final closing of the medium-filled package.

It will thus be possible to make ice cube bags filled with liquid and which may subsequently be moved directly to a freezing unit where a complete or partial freezing of the ice cubes is performed. The ice cubes may then be moved directly to a storage compartment, either intended for immediate sale/distribution or from where they may be sold/distributed after a shorter or longer period of storage.

The method and apparatus according to the invention may thus be suited for application in the making of ice cube bags that are frozen, as the parts of the apparatus in a simple way may be disposed over a freezer used for storing and distributing the ice cubes. Hereby is achieved the advantage that the production of the liquid-filled packing and the freezing itself for the formation of the ice cubes can be moved out into a retail store.

Thus is achieved advantages of the keeping qualities of the filled product, and furthermore there will be far less requirements to the strength of film material as the filled product does not have to be handled through the usual distribution chains from producer to retailer.

The requirement to strength of the film will thus be significantly reduced. In principle, the films can be made so thin as technically possible, if only the plastic can protect the formed ice cubes.

The plastic film does not need to have a strength so that it can resist the loads arising during transport, where liquid-filled packings from producer to retail may be subjected to considerable pressure actions.

If the system according to the invention is used for making water packings for water machines/distribution units, the filling will normally occur in a separate bottlery, and the water-filled packings are subsequently to be transported to the retailer. In such a situation of use, the water-filled packings may be provided with drawing taps so that they are adapted to be placed immediately in a distribution unit.

The thickness of the film to be used for such liquid-filled packings is to be dimensioned according to the load occurring during the filling with the liquid-filled containers suspended in the rollers as well as the load that may occur during transport.

In practice it has appeared that the decisive dimensioning factor will be the weight that may be carried during production, as a film product has very inferior carrying ability if the film is heated and thereby softened. Also in connection with liquid-filled packings for water containers, which may have a volume of 5-10 liters or even larger volume, it will be advantageous to use the system according to the present invention.

By the making of the medium-filled packings, these may either before or immediately after being separated from the film webs be conveyed to subsequent treatment.

Subsequent treatment in the form of freezing of liquid is mentioned above. Freezing may thus be effected before the individual packings are separated from the film webs. In some situations, this may be an advantage. Possible leakages occurring in welds in the transverse direction of the film webs will therefore not give rise to leaking of liquid if freezing is performed before dividing into transverse separation areas between the transverse weldings.

Other subsequent treatment may e.g. be packing, radiation treatment, heating or other kinds of subsequent treatment performed before the liquid-filled packings are distributed/sold.

A particular embodiment of the method according to the invention is peculiar in that the longitudinal sealings are formed by a series of L-shaped sealings, where the small leg of the L is superposed the long leg of the L in a subsequent sealing action. In a safe way is hereby achieved a longitudinal sealing without any perforations, even if the film webs will be drawn downwards due to the suspended weight, so that they assume a profile with side edges which are directed inclining downwards and inwards.

In a special embodiment of the apparatus used for making ice cubes, the heat sealing means will include welding jaws which can reciprocate between an active position for contact with the film webs in order to thermally seal the latter, and an inactive position wherein the film webs may be moved freely between the welding jaws. The reciprocating movement of the welding jaws may thus be performed synchronously with the conveying and the filling of liquid.

If the medium filling means are provided with blocking means, it is possible that the medium may be filled successively into the packing during the formation. Thus thermal sealing of the film webs and medium filling for the formation of medium-filled compartments or sections may be performed alternatingly before a final closing is performed. This enables a rapid filling of packings to be used as ice cube bags, where otherwise there would be a slow filling if a liquid was to run through the entire packing and through a long series of chambers interconnected by small passages for forming the final liquid-filled packing.

This embodiment will thus be particularly suited for making liquid-filled packing which is moved directly to a freezer and then to a storage compartment in a distribution unit which may be located in a retail store.

According to the invention, any medium-filled packing can be brought via a treatment unit to a storage compartment in a distribution unit that may be disposed in a retail store, or directly to such a storage compartment in a distribution unit which can be placed in a retail store.

In such a situation, the apparatus according to the invention may be combined with special monitoring means so that it is only activated when the level of medium-filled packings, e.g. filled ice cube bags, go below a certain value in the distribution unit.

By the system according to the invention, it will be possible to provide a germ-free medium-filled packing. This will be the case by filling any packing with liquid or solid. It is thus possible both in the situation where ice cube bags are produced and in the situation where liquid-filled containers are produced for use in water machines.

DESCRIPTION OF THE DRAWING

In the following, the invention will be explained in more detail with reference to the enclosed drawing wherein.

Figure 1:
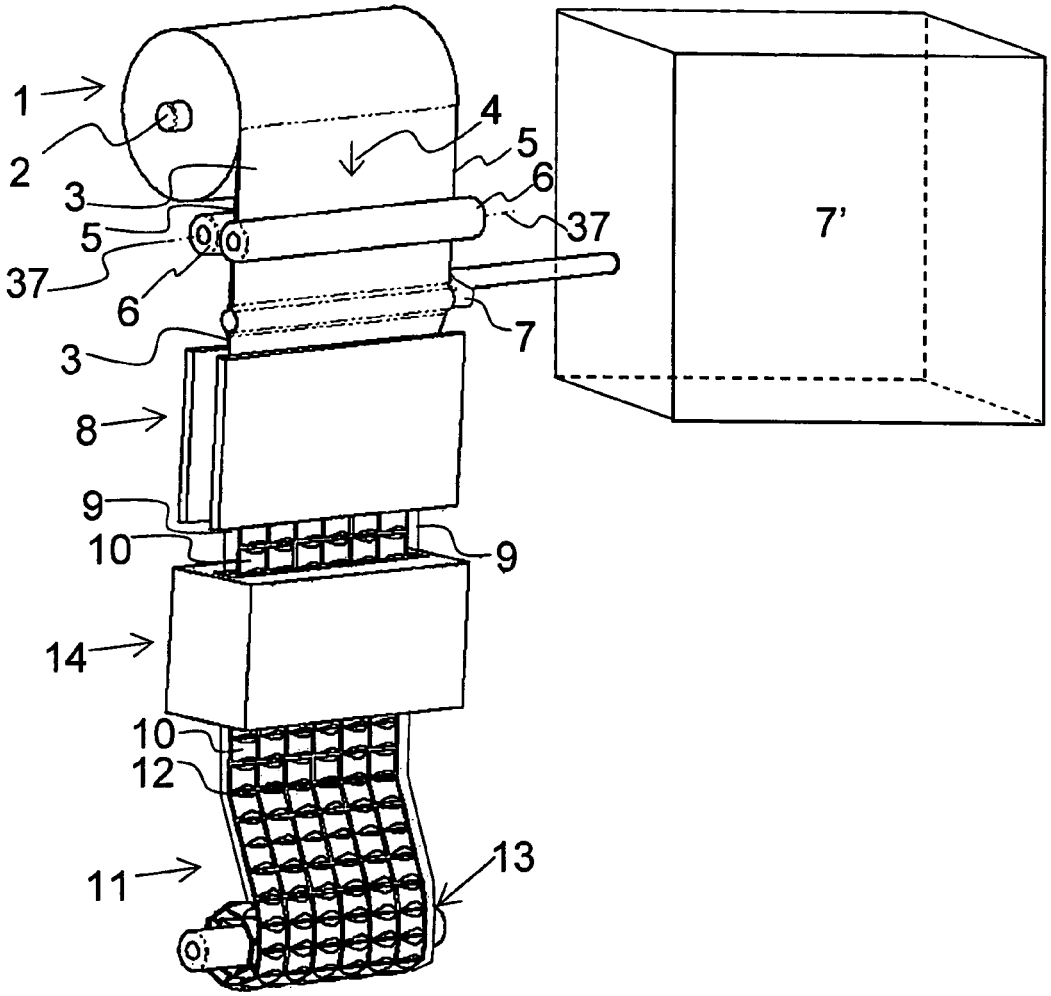
FIG. 1 shows a schematic-diagram of a first method according to the invention.

Identical or corresponding features below will be provided with the same references throughout the various Figures of the drawing.

DETAILED DESCRIPTION OF THE INVENTION

FIG. 1 illustrates a roll 1 rotating about a journal 2 for unwinding two superposed film webs 3 which are advanced in direction of arrow 4. The film webs have longitudinally extending side edges 5. The film webs are passed between two rollers 6 which are pressed against each other for compressing and retaining the film webs 3 therebetween.

Under the rollers 6, a water supply pipe 7 is disposed, connected to a water supply source 7' in the interspace between the superposed film webs 3. At a position downstream of the rollers 6, as seen in the conveying direction 4 of the film webs, there is provided a welding station 8 with which a thermal sealing can be performed for welding the superposed film webs.

The welding station 8 is provided with welding jaws (27, 28 see FIGS. 3 and 4) extending across part of the distance between the side edges 5 of the film webs, so that two unbroken longitudinal areas 9 are left in the longitudinal direction of the film webs.

In the shown embodiment, the two longitudinal areas 9 in which no welding is present are provided adjacent to the side edges 5 of the film webs. In the interspace there between, weldings are provided, forming ice cube pockets 10 in the packing 11.

In the welding station 8, transverse weldings 12 are also established for mutual separation of the individual packings 11. The packings 11 can be conveyed to a storage 13 which in the shown form is illustrated as a roll. Alternatively, there may be a storage where separate packings 11 are disposed in random order or stacked.

In the shown embodiment, there is illustrated a freezing station 14 after the welding station. This means that after the freezing station, packings 11 will contain frozen ice cubes, as the water filled into the packings via the water supply pipe 7 is frozen to ice in the freezing station 14.

Alternatively, it is possible that the welding station only performs longitudinal welds and transverse welds for forming packing containers containing a single compartment for the liquid. Likewise, it will be possible to omit the freezing station. By an alternative method there will thus be filled containers with water.

In the shown embodiment, the unbroken longitudinal areas 9 where no welding appears will enable support of the film webs in the nip between the rollers 6. Thus there is no need for other support means by the filling of the packings 11.

Figure 2:
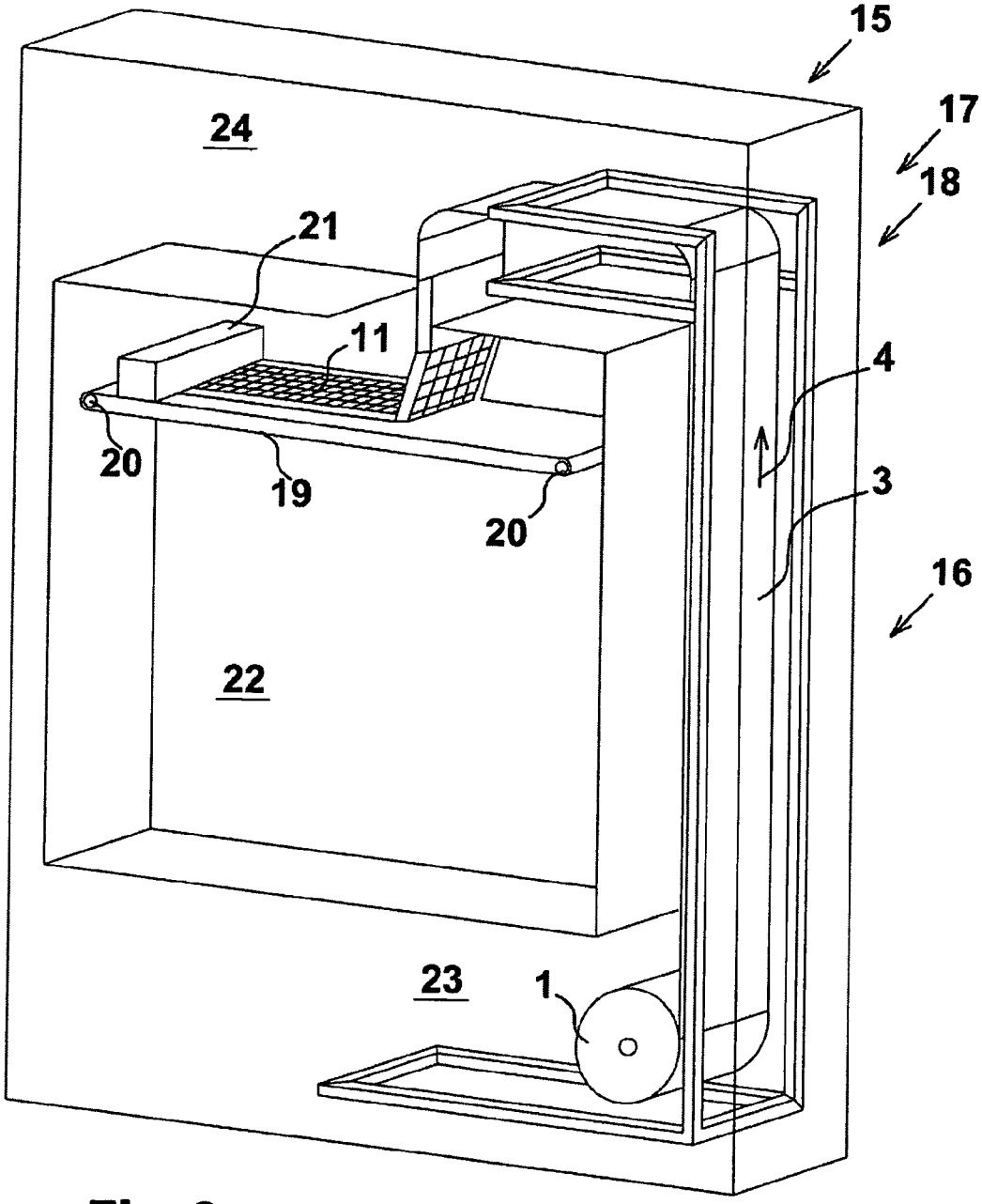
FIG. 2 shows in principle the design of an upright freezer for use in the method according to the invention.

FIG. 2 shows an upright freezer 15. At the bottom of the freezer there is provided a supply roll 1 with double-layered film web 3. The film web is passed up along a side edge 16 in the freezer to an upper part 17 of the freezer. As shown in FIG. 1, the rollers 6 and the welding station 8 are provided at an upper part in the area 18.

The film web is conveyed from the welding station 8 down on a conveyor belt 19 which is passed around two rollers 20. The packings 11 are placed on the upper run of the belt 19. In this embodiment, the division into separate packings may be effected at the welding station 8.

Alternatively, the separation may occur at a separate separation station 21 which is provided at the end of the belt 19. The liquid-filled packing 11 will thus first be separated from the web in the station 21 so that they fall down into a freezing compartment 22 as individual frozen packings.

The compartment 22 will be a freezer compartment. A compartment 23 wherein the film web is placed will be outside the freezing compartment as well as a compartment 24 with the upper part 17 being frost-free. The upright freezer will thus be provided with insulation of the compartment 22 in which freezing temperature is maintained by commonly known techniques. The upright freezer 15 may be cabinet located in a shop, and the customers will have access to take out the frozen packings via doors 25.

Figure 3:
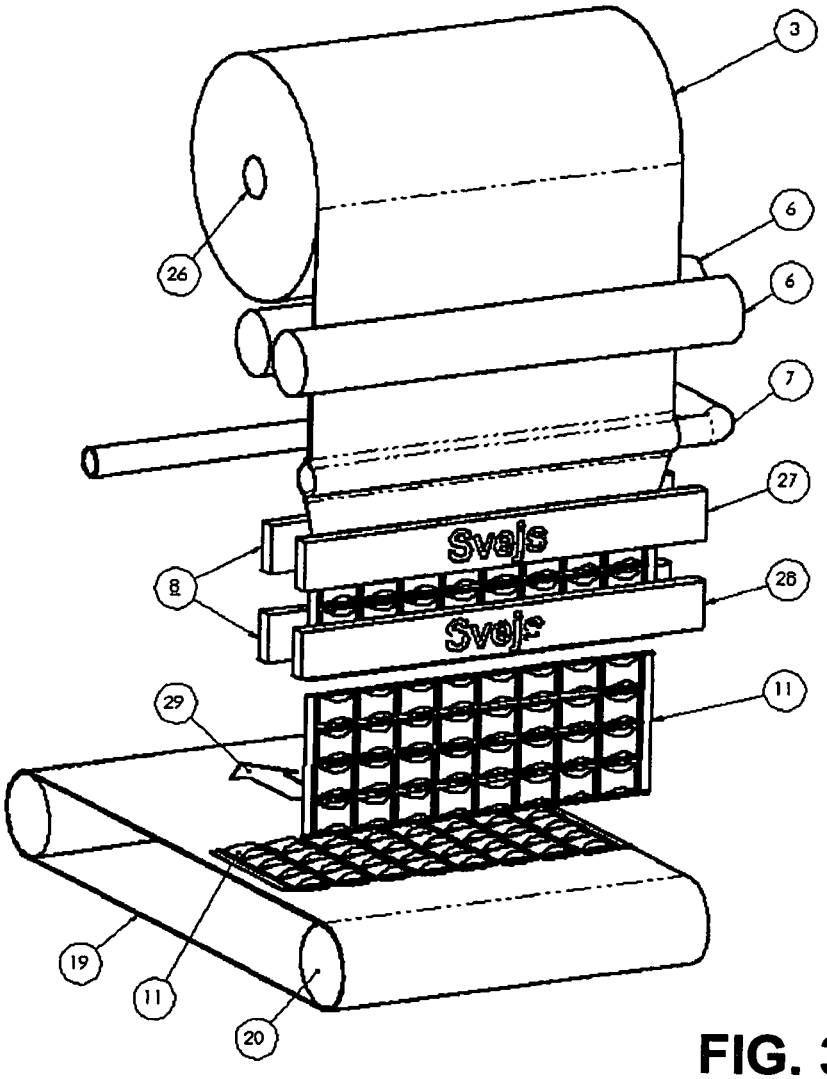
FIG. 3 shows a schematic view of an apparatus according to the invention, as seen from the side.
Figure 4:
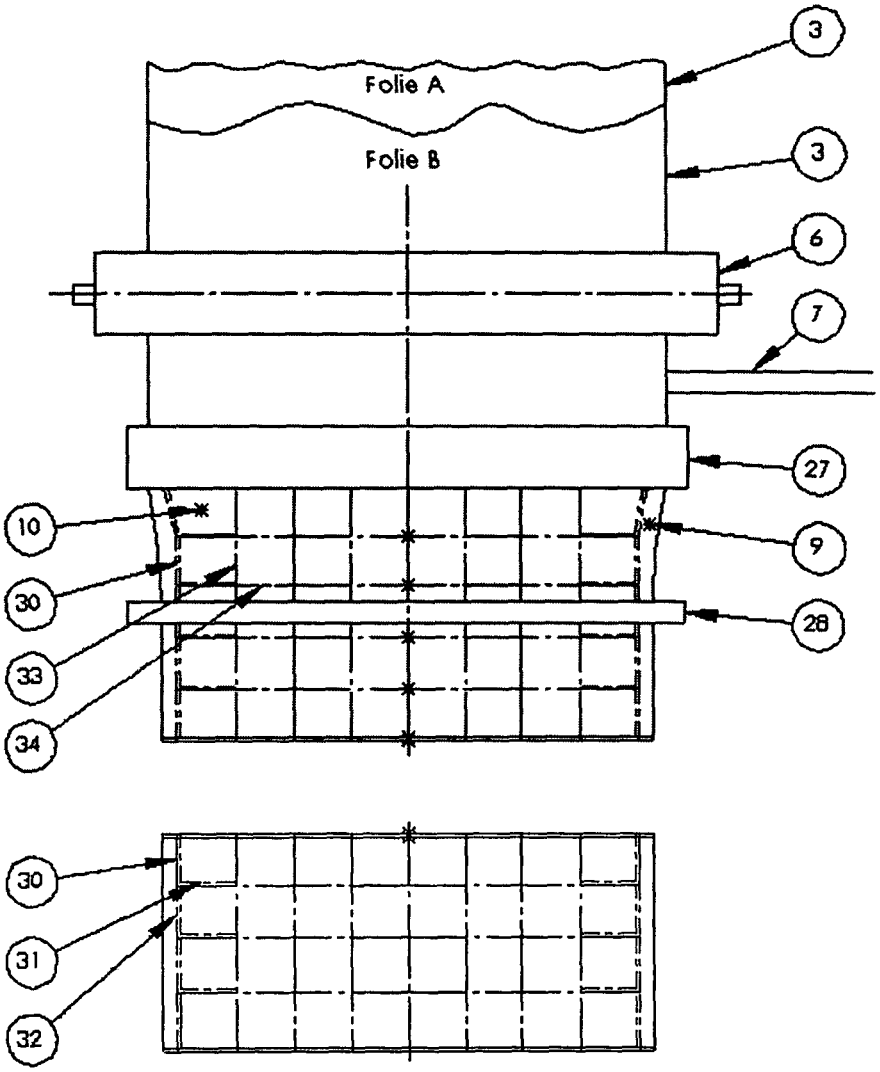
FIG. 4 shows a schematic view of the apparatus shown in FIG. 3, as see from the front.

FIGS. 3 and 4 show how the film web 3 is passed around a roller 26 before it goes between the rollers 6 pressing against each other and retaining the film web. In this design, the welding station is formed by a first welding jaw 27 which provides a welding forming single chambers, and which does not extend across the entire film web. Furthermore, there is a second welding jaw 28 which is intended for a transverse termination and separation of the packings 11 from the film web 3.

The weight to be carried by the rollers 6 will thus be weight of the liquid-filled packings 11 located between the water supply pipe 7 and the lower end of the welding jaw 8, where separation is performed.

The separate liquid-filled packings 11 are then laid on the conveyor belt 19 and conveyed in direction of arrow 29 to subsequent treatment and/or storage.

As alternative to welding jaws for separation, scissors, knives or similar may be used, provided in separation station 21 which is located at the end of the belt 19 (see FIG. 2).

As it particularly appears from FIG. 4, spot weldings are formed in the welding jaw 28, forming pockets 10 for the formation of ice cubes.

At the outer side edges, the sealings in longitudinal directions are formed by L-shaped sealings or weldings 30. As it is clearly seen in lower part of FIG. 4, the L-shaped sealings are made with slightly greater length in longitudinal direction of the film webs than the other longitudinal weldings 33 for the formation of the pockets. The small leg 31 of the L will thus be superposed the long leg 32 of the L in a subsequent sealing. This ensures that a tight and unbroken sealing is provided in longitudinal direction, irrespective of the tension occurring in the film due to the liquid-filled containers. Such a tension will cause a somewhat downwards tapering orientation of the film web as indicated on FIG. 4. The L-shaped configuration of the sealings 30 will thus compensate for the tapering formation of the film webs.

Between the L-shaped sealings 30 are formed punctiform sealings 33 running in longitudinal direction of the film and punctiform sealings 34 extending in transverse direction of the film. The length of the sealings 33 corresponds to the length with the film web is displaced before performing a subsequent thermal sealing with welding jaw 27. Thus there will appear a welding pattern as illustrated in lower part of FIG. 4 with the longer L-shaped sealings 30 in superposed condition.

Figure 5:
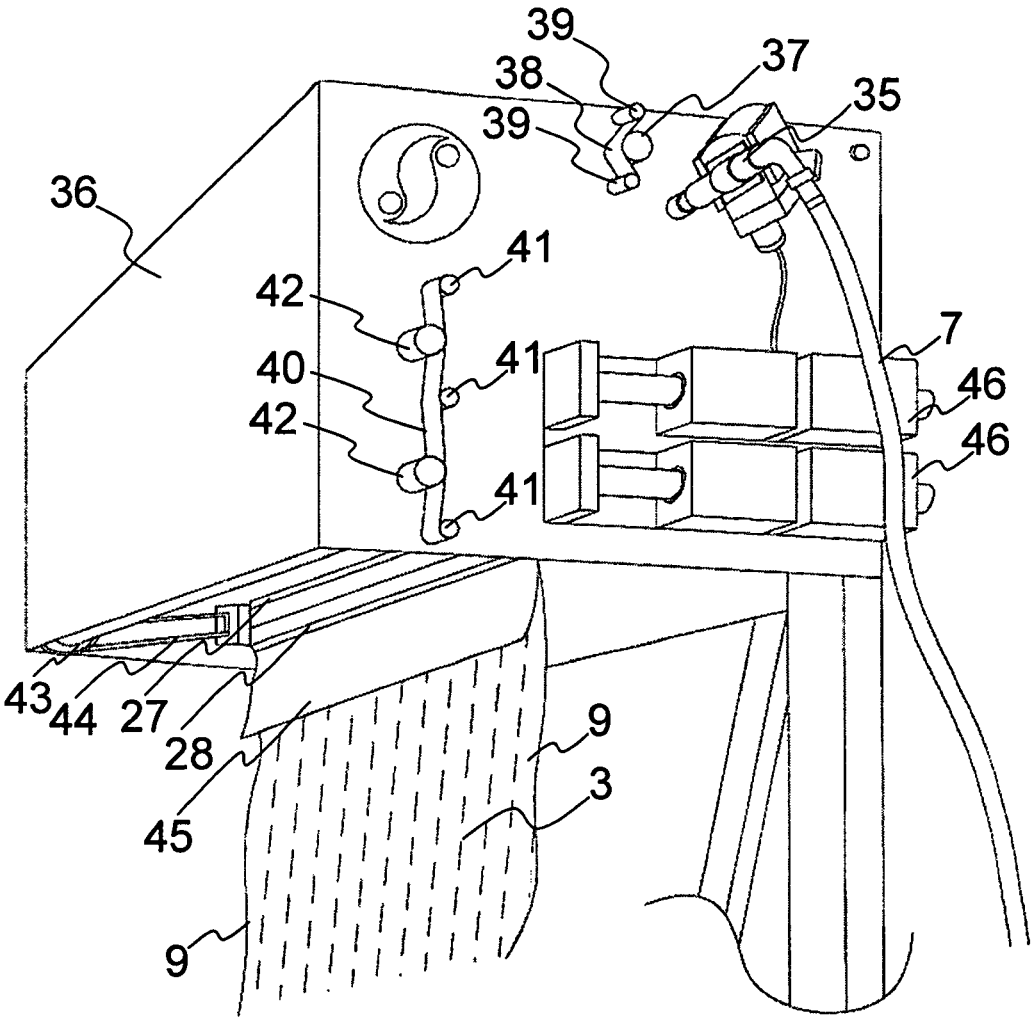
FIG. 5 shows a partial view of an apparatus according to the invention.

FIG. 5 shows a partial, however more detailed view of the apparatus according to the invention. It appears that the water supply pipe 7 is provided with a valve mechanism 35 which is used for disconnecting and connecting the water supply concurrently with the stepwise conveying of the film webs 3.

It appears that the apparatus includes a cabinet 36 in which water supply pipes, rollers and welding jaws are disposed. In the Figure appears a shaft 37 for one of the rollers 6. The roller 6 is pressed into abutment against the other roller 6 (not shown) by means of a spring bracket 38 which is mounted between two anchoring points 39 in the cabinet 36. A corresponding spring bracket 38 is provided in order to press the second roller in direction against the first roller 6.

Alternatively, it will be sufficient with a single spring bracket, if only the spring force is adjusted so that the squeezing force between the two rollers 6 is sufficient to retain the two superposed film webs by the squeezing of the unbroken longitudinal areas where no thermal sealing occurs.

Furthermore is seen a spring bracket 40 which is fastened at anchoring points 41. The spring bracket 40 serves to urge shafts 42 supporting drive wheels 43 for wires 44. The wires are connected with the welding jaws 27, 28 and driven by a motor for establishing a reciprocating movement of the welding jaws 27, 28 at the thermal sealing of the film webs.

The welding jaws 27, 28 are provided with a Teflon film 45 which is replaceable and which prevents the film webs 3 from adhering to the welding jaws 27, 28.

Moreover, in FIG. 5 two lateral guides 46 are seen for ensuring the reciprocating movement of the welding jaws 27, 28.

Figure 6:
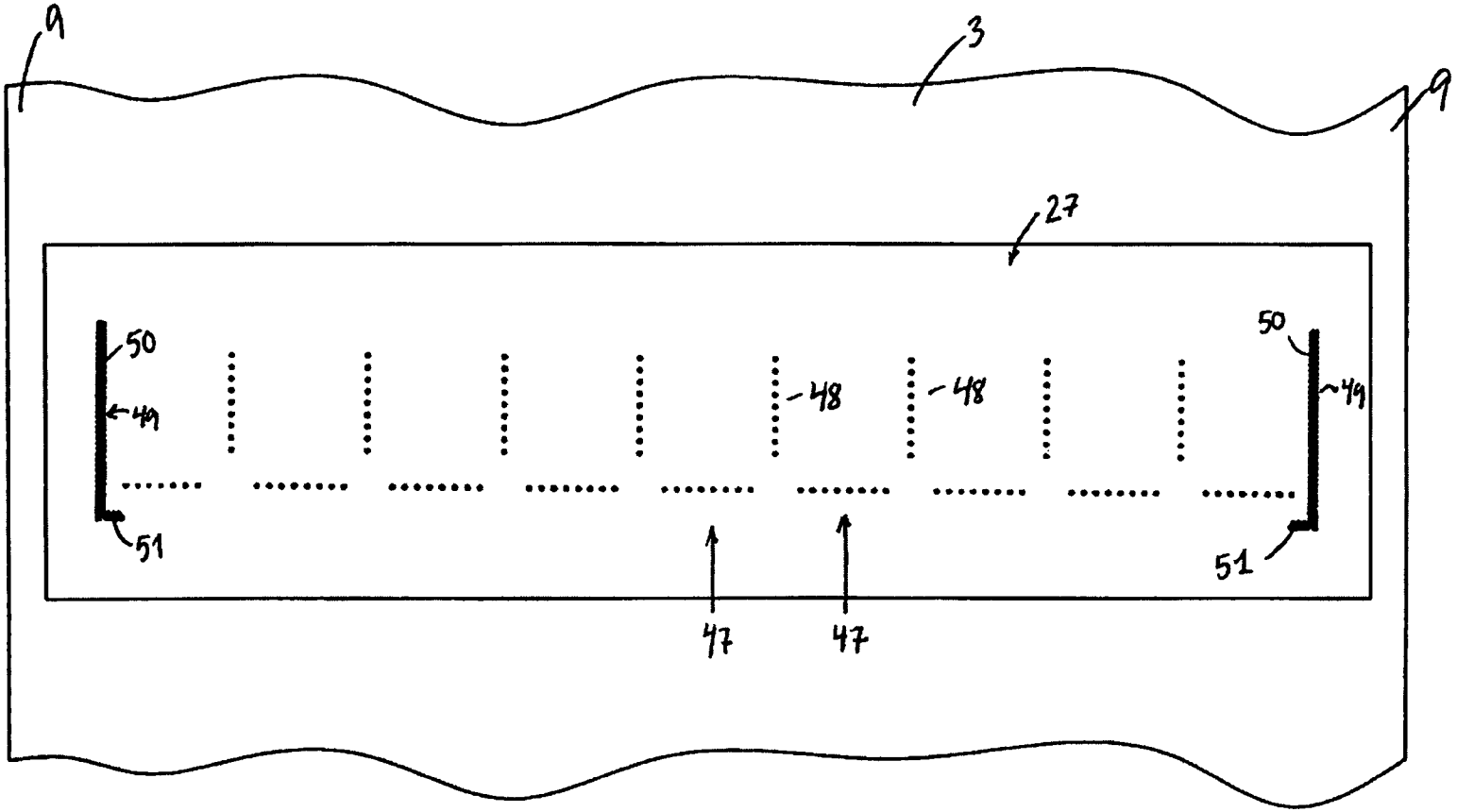
FIG. 6 shows a view of a thermal sealing means for use in the apparatus according to the invention.

FIG. 6 illustrates the pattern on a welding jaw 27. The welding jaw 27 has a pattern with a size which is less than the width of the film webs 3, as also indicated in this Figure. The pattern of the welding jaw includes projections 47 intended for disposition transversely of the film web, and projections 48 intended to run in the longitudinal direction of the film web. At the outer ends, two L-shaped projections 49 are provided, having an elongated part 50 which is longer than the projections 48 and intended to be disposed in longitudinal direction of the film web, and a short transverse part 51 intended to be in the transverse direction of the film web. By the special design of the welding jaw 27 is achieved the above mentioned L-shaped sealing of the film web.

Figure 7:
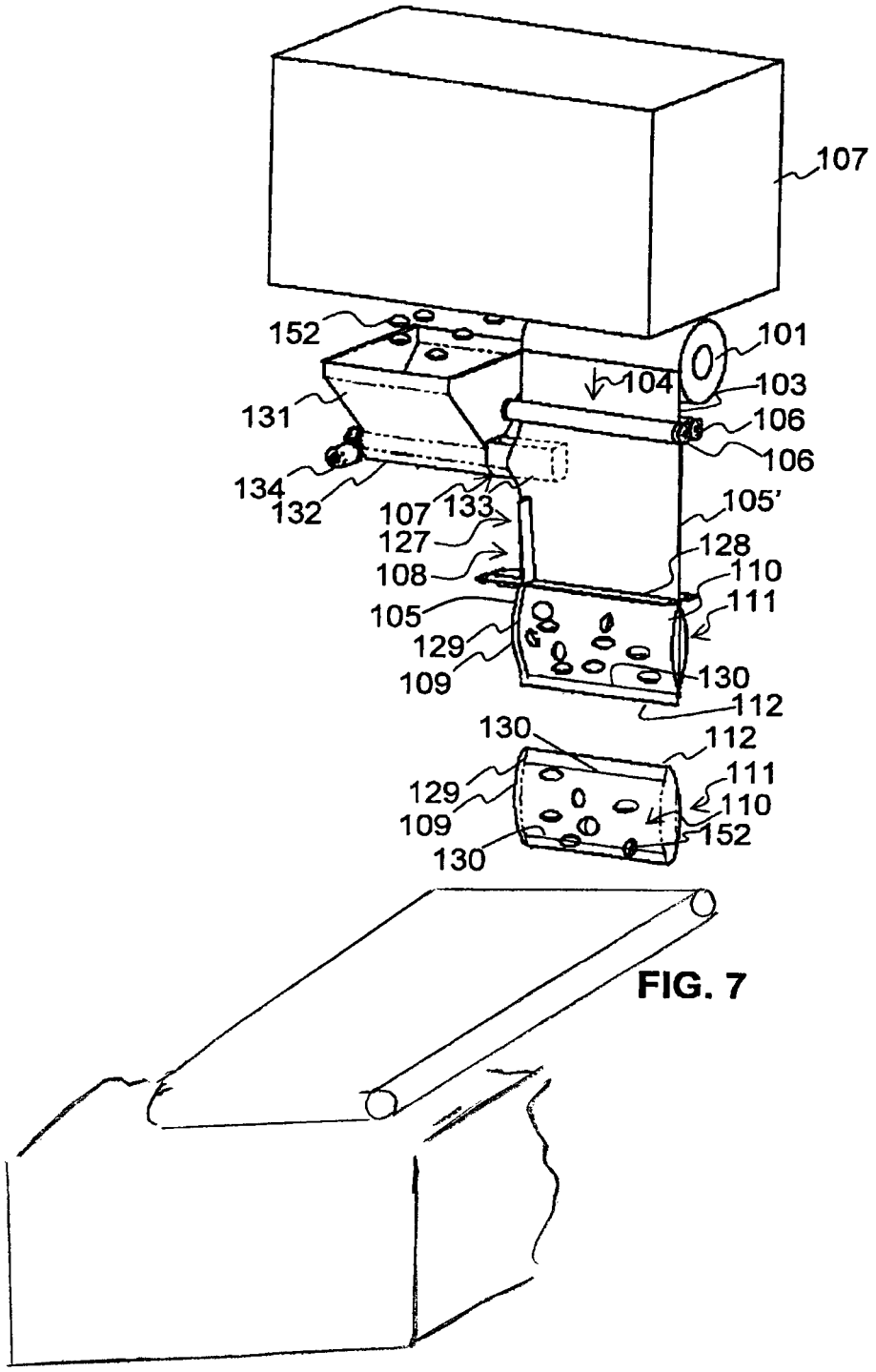
FIG. 7 shows a schematic diagram of a further method according to the invention.
Figure 8:
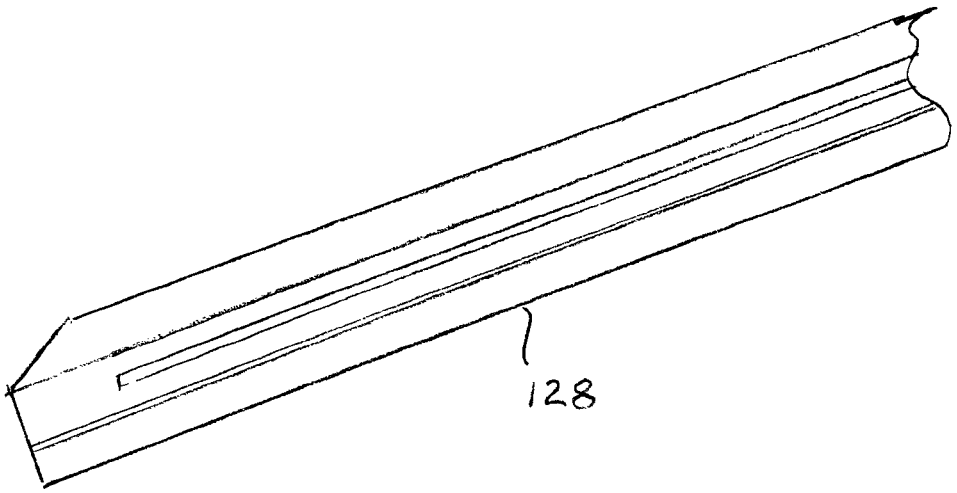
FIG. 8 shows an enlarged view of the longitudinal and transverse welding jaws of FIG. 7.

FIG. 7 illustrates a further embodiment of a method according to the invention, where ice cubes 152 are filled into the formed packings instead of liquid.

FIG. 7 illustrates a roll 101 rotating about a journal (not shown) for unwinding two superposed film webs 103 which are advanced in direction of arrow 4. In the shown embodiment, the film webs 103 are produced by folding a film edge around one edge area marked with 105. The film webs thus have two longitudinally extending side edges 105 and 105'. At the side edges 105, the film webs are not joined when located in the roll 101. The film webs 103 are passed between two rollers 106 which are pressed against each other for compressing and retaining the film webs 103 therebetween.

Under the rollers 106 is disposed an feeding unit 107 for introducing ice cubes 152 into the interspace between the superposed film webs 103. At a position downstream of the rollers 106, as seen in the conveying direction 104 of the film webs, there is provided a welding station 108 with which a thermal sealing can be performed for welding the superposed film webs together.

The welding station 108, which will be explained in more details in the following, is provided with two welding jaws 127, 128. These extend across part of the distance between the side edges 105, 105' of the film webs, so that an unbroken edge area 109 is left in longitudinal direction of the film web at the side edge 105. Welding jaw 127 performs welding 129 which is largely running in parallels with the side edge 105. Transverse weldings are performed with the welding jaw 128. A transverse welding 112 extending from the side edges 105 to the side edges 105' is performed. However, the welding jaw is also intended for making transverse weldings 130 which do not extend across the entire width, but stop at the welding 129. By the welding is thus formed a packing 111 with an inner compartment 110 in which the ice cubes 152 are placed. As seen such a compartment 110 will be surrounded by an unwelded edge area along the entire circumference, except at the side edges 105'.

As an alternative to the above described method, the superposed sheets 103 may be formed by two separate sheets, like in the previously described embodiment.

In an alternative embodiment, it will also be possible to provide the welding station 108 with a further welding jaw extending in longitudinal direction of the film web, corresponding to the welding jaw 127. Such an additional welding jaw may perform a welding in longitudinal direction of the film web close to the side edges 105', so that two unbroken edge areas are formed in longitudinal direction of the film webs.

The feeding unit 107 includes a funnelshaped part 131 into which the ice cubes 152 fall down from a supply source 107'. At the bottom of the funnelshaped part there is a U-shaped channel 132 in which is provided a screw 133 driven by a motor 134. The ice cubes 152 will thus be introduced between the film webs 103 by means of the screw 133.

The introduction of the ice cubes 152 is effected interchanging with activation of the welding jaws 127, 128 of the welding station 108.

The welding station 108 has two welding jaws 127 and 128 that may be applied/activated independently of each other.

When thus a first packing is to be formed, the welding jaw 128 is activated, establishing the transverse welding 112 and the partly transverse welding 130. At the same time, the vertical welding jaw 127 is activated, forming a first part of the longitudinal weld 129. At this time, ice cubes 152 may be filled into the (partly formed) packing. After a filling, the film webs 103 are conveyed in direction of arrow 104.

Then the welding station 108 is activated again. However, at this time only the welding jaw 127 will be activated. Hereby, the weld 129 is extended. Hereafter additional filling is performed. Such extending of the weld 129 may take place one or more times, depending on which content is wanted in the formed packing. When a packing has been filled with desired contents as defined by the rotation of the screw at each sequence in which ice cubes are filled into the formed packing, the welding station 108 is activated again.

In this situation the welding jaw 128 is activated. By the welding, transverse welds are formed, as the welding jaw may contain several welding wires **128*a*, 128*b* so that by the same activation of the transverse welding jaw 128 a transverse welding 112 and two adjacent partial welds 130** are formed at each side for the formation of the side edges of the packing.

After the welding station 108, the filled packings may be transferred directly to a sales unit.

By the embodiment shown in FIG. 7, it will thus be possible to provide a packing which substantially corresponds to the one previously described, however with bags in which ice cubes are disposed loosely without the use of freezing pockets.

It is to be noted that by activation of the welding jaws 128, the transverse welding 112 may either establish an intersection 126 or just such a perforation that the individual packings 111 may be separated from each other afterwards.

By applying the method illustrated in FIG. 7, it is thus possible to perform a partial filling after the first welding step with a limited amount of ice cubes in the packing. Then these ice cubes will provide a weight which contributes to producing a pull advancing the film webs 103.

However, it is also to be noted that the conveying of the film webs will be controlled by a stepwise advancing of the film. Such a stepwise advancing may e.g. occur by stepwise advancing of a support upon which the packing rests, or by stepwise advancing of driven rollers 106.

Also, stepwise conveying may also be established by using the welding station in a situation where the welding jaws are not activated, but only performing a pulling action in the film webs.

In use, the welding jaws will be moved to a position from each other in order to avoid cooling of the welding jaws by the ice located in the packing. The welding jaws will thus be disposed with such mutual spacing that they do not prevent the downwards travel of the partial packing between the opposed welding jaws.

Even though there is described a method and an apparatus in FIG. 7 in which ice cubes 152 are filled into the formed packing 111, it will also be possible to fill the packing 111 with other solid media.

Likewise, it will be possible to use a feeding unit 107 which is designed differently from the one shown, when only it is ensured that the introducing of medium through the not welded side edges of the two superposed film webs 103 under the rollers 106 and at a position above the welding station 108 can be controlled.

The invention claimed is:

1. A packaging apparatus comprising:

a supply roller, a roll of superposed heat-sealable elongated plastic pair of film webs elongated in a longitudinal direction of suspension on the supply roller, each of the pair of film webs having inner opposite containment sides facing each other and outer ambient facing sides, a pair of driven rollers between which the pair of film webs is passed, pressers for pressing the pair of driven rollers against each other for compressing and retaining the pair of film webs therebetween, a horizontal thermal sealing device disposed downstream of the pair of driven rollers in a conveying direction of the pair of film webs and adapted to reciprocatingly move into and out of contact with the pair of film webs, wherein the horizontal thermal sealing device is configured to:

thermally seal the pair of film webs across an entire width of the pair of film webs at a first longitudinal position along the longitudinal length of the pair of film webs, and thermally seal the pair of film webs across a part of the width of the pair of film webs at a second longitudinal position along the longitudinal length of the pair of film webs, the second longitudinal position being different from the first longitudinal position, wherein the part of the width of the pair of films webs is horizontally spaced from at least one longitudinal edge of the pair of film webs, a vertical thermal sealing device disposed downstream of the pair of driven rollers in a conveying direction of the pair of film webs and adapted to reciprocatingly move into and out of contact with the pair of film webs, wherein the vertical thermal sealing device is configured to thermally seal the pair of film webs across a part of the longitudinal length of the pair of film webs, wherein the part of the longitudinal length of the pair of film webs is horizontally spaced from at least one longitudinal edge of the pair of film webs, and a medium-filler comprising medium for filling packages with the medium and forming medium-filled packages, wherein the packages are adapted to be formed by the horizontal thermal sealing device and the vertical sealing device.

2. The apparatus of claim 1, wherein the horizontal thermal sealing device is adapted to reciprocate between an active position in contact with the pair of film webs for a horizontal thermal sealing of the pair of film webs, and an inactive position wherein the pair of film webs moves freely through the horizontal thermal sealing device.

3. The apparatus of claim 2, wherein the vertical thermal sealing device is adapted to reciprocate between an active position in contact with the pair of film webs for a vertical thermal sealing of the pair of film webs, and an inactive position wherein the pair of film webs moves freely through the vertical thermal sealing device.

4. The apparatus of claim 1, wherein the filling of the packages with the medium by the medium-filler and the reciprocating movement of the vertical thermal sealing device are alternated before closing the medium-filled packages.

5. The apparatus of claim 1, wherein the medium-filler is disposed between the support rollers and the horizontal and vertical thermal sealing devices.

6. The apparatus of claim 1, wherein the medium-filler is disposed between the pair of film webs through an unsealed edge area.

7. The apparatus of claim 1, wherein the medium is selected from the group consisting of fluids, solids, liquids, ice-cubes, or combinations thereof.

8. A method of making ice cubes-filled packages comprising:

providing a roll of superposed heat-sealable elongated plastic pair of film webs elongated in a longitudinal direction of suspension on one supply roller, each of the pair of film webs having inner opposite containment sides facing each other and outer ambient facing sides, passing the pair of film webs between a pair of driven rollers, pressing the driven rollers against each other, compressing and retaining the pair of film webs between the rollers, passing the pair of film webs through a welding station downstream of the pair of driven rollers, the welding station comprising a horizontal welding jaw and a vertical welding jaw, forming packages of the pair of film webs with the welding station, comprising:

reciprocatingly moving the horizontal welding jaw into and out of contact with the pair of film webs to thermally seal the pair of film webs across an entire width of the pair of film webs at a first longitudinal position along the longitudinal length of the pair of film webs, and to thermally seal the pair of film webs across a part of the width of the pair of film webs at a second longitudinal position along the longitudinal length of the pair of film webs, the second longitudinal position being different from the first longitudinal position, wherein the part of the width of the pair of film webs is horizontally spaced from at least one longitudinal edge of the pair of film webs, and reciprocatingly moving the vertical welding jaw into and out of contact with the pair of film webs to thermally seal the pair of film webs across a part of the longitudinal length of the pair of film webs, wherein the part of the longitudinal length of the pair of film webs is horizontally spaced from the at least one longitudinal edge of the pair of film webs, filling the packages with ice cubes from a supply source disposed between the containment sides of the pair of film webs downstream of the pair of driven rollers, closing the packages and forming ice cubes-filled packages, closing the ice cubes-filled packages with the horizontal welding jaw, and separating the ice cubes-filled packages from the pair of film webs.

9. The method of claim 8, further comprising alternating the thermal sealing of the pair of film webs with the filling of the ice cubes, successively filling the ice cubes into the packages during the forming of the packages and forming one or more ice cubes-filled compartments or sections in the packages before closing the ice cubes-filled package.

10. The method of claim 8, further comprising conveying the separated ice cubes-filled packages directly to a storage unit and storing and distributing the ice cubes-filled packages from the storage unit.

* * * * *